US007997552B2

(12) United States Patent
Engebretson et al.

(10) Patent No.: US 7,997,552 B2
(45) **Date of Patent: *Aug. 16, 2011**

(54) SUSPENSION SYSTEM

(75) Inventors: Mark Engebretson, Huntington Beach, CA (US); Mary Vosse, Culver City, CA (US); Harald Kanz, North Hills, CA (US); Yoshiyuki Takeuchi, Pine Mountain Club, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 49 days.

This patent is subject to a terminal disclaimer.

(21) Appl. No.: 12/402,348

(22) Filed: Mar. 11, 2009

(65) Prior Publication Data

US 2009/0230273 A1 Sep. 17, 2009

Related U.S. Application Data

(63) Continuation of application No. 11/648,157, filed on Dec. 28, 2006, now Pat. No. 7,516,932.

(60) Provisional application No. 60/755,287, filed on Dec. 30, 2005.

(51) Int. Cl.
*A47H 1/10* (2006.01)

(52) U.S. Cl. ..... 248/317; 381/386; 381/387

(58) Field of Classification Search ..... 248/317, 248/544, 201, 220.1, 220.22, 222.51, 223.41, 248/324, 291.1, 292.14, 297.21; 403/362, 403/65; 381/87, 322, 335, 336, 386, 387, 381/395; 181/395, 30, 198, 199

See application file for complete search history.

(56) References Cited

U.S. PATENT DOCUMENTS

| | | | |
|---|---|---|---|
| 3,778,562 | A | 12/1973 | Wright |
| 4,660,728 | A | 4/1987 | Martin |
| 4,845,759 | A | 7/1989 | Danley |
| 5,181,685 | A | 1/1993 | Ostapowicz |
| 5,590,214 | A | 12/1996 | Nakamura |
| 5,602,366 | A | 2/1997 | Whelan et al. |
| 5,749,137 | A | 5/1998 | Martin |
| 5,758,852 | A | 6/1998 | Martin |
| 5,819,959 | A | 10/1998 | Martin |
| 5,833,186 | A | 11/1998 | Kosmoski et al. |

(Continued)

OTHER PUBLICATIONS

Frink, Mark; JBL Vertec Line Array System; Mix Magazine; Technology Spotlight; Oct. 2000; pp. 148-149.

(Continued)

*Primary Examiner* — Ramon O Ramirez
(74) *Attorney, Agent, or Firm* — The Eclipse Group LLP

(57) ABSTRACT

A system is provided for suspending a plurality of line array loudspeakers. The suspension system includes a rigging bar having an engaging member, such as a pivotal member, positioned near one end of the rigging bar. The engaging member includes a free end capable of extending outward past the end of the rigging bar in which the engaging member is positioned. The end of the rigging bar opposite the pivotal member is designed to releasably receive an engaging member of an adjacent rigging bar. The free end of the engaging member of the rigging bar may include a hole that aligns with holes positioned in the receiving end of the rigging bar. The engaging member of one rigging bar may then be secured to an adjacent rigging bar by aligning holes of the engaging member of a first rigging bar with the holes in the receiving end of a second rigging bar and inserting a release pin through the aligned holes.

20 Claims, 19 Drawing Sheets

U.S. PATENT DOCUMENTS

| | | | | |
|---|---|---|---|---|
| 5,947,434 | A | 9/1999 | Kosmoski et al. | |
| 5,966,728 | A | 10/1999 | Amini et al. | |
| 5,996,728 | A * | 12/1999 | Stark | 181/144 |
| 6,016,353 | A | 1/2000 | Gunness | |
| 6,095,279 | A | 8/2000 | Adamson | |
| 6,112,847 | A | 9/2000 | Lehman | |
| 6,425,563 | B1 * | 7/2002 | Mihailoff | 248/245 |
| 6,640,924 | B2 * | 11/2003 | Messner | 181/144 |
| 6,652,046 | B2 * | 11/2003 | Christner | 312/111 |
| 6,810,127 | B2 * | 10/2004 | Bronson, III | 381/345 |
| 7,298,860 | B2 * | 11/2007 | Engebretson et al. | 381/386 |
| 2002/0071580 | A1 * | 6/2002 | Engebretson et al. | 381/182 |
| 2002/0153195 | A1 * | 10/2002 | Messner | 181/198 |
| 2003/0127280 | A1 * | 7/2003 | Engebretson | 181/199 |
| 2004/0131217 | A1 * | 7/2004 | Opie et al. | 381/336 |
| 2004/0213425 | A1 * | 10/2004 | Simidian et al. | 381/335 |
| 2004/0218773 | A1 * | 11/2004 | Andrews | 381/335 |
| 2005/0008165 | A1 * | 1/2005 | Sack et al. | 381/59 |
| 2005/0201583 | A1 * | 9/2005 | Colich | 381/335 |
| 2005/0232455 | A1 * | 10/2005 | Monitto et al. | 381/335 |

OTHER PUBLICATIONS

Meserve, Paul; Conventional Wisdom Challenged; Live Soundl; Sep./Oct. 2000; pp. 44-49.

* cited by examiner

SUSPENSION SYSTEM

CROSS-REFERENCE TO RELATED APPLICATIONS

This application is a continuation of and claims priority to U.S. application Ser. No. 11/648,157, filed Dec. 28, 2006 now U.S. Pat. No. 7,516,932, titled SUSPENSION SYSTEM; that claims priority under 35 U.S.C. §119(e) of U.S. Provisional Patent Application No. 60/755,287, filed Dec. 30, 2005, titled SUSPENSION SYSTEM, which application is incorporated by reference in this application in its entirety.

BACKGROUND OF THE INVENTION

1. Field of the Invention

This invention relates generally to a suspension system for line array loudspeakers. In particular, the invention relates to a system of assembling and suspending a plurality of speakers in a line array.

2. Related Art

In the realm of loudspeaker sound systems, a line-source array is generally a group of similarly sized sound radiating sources that provide increased directivity at various frequencies. Loudspeaker line arrays can offer significant advantages over traditional multi-box sound systems. For example, loudspeaker line arrays provide an extension of the near-field coverage area because the distance from the near field to far field transition zone is increased with frequency. This phenomenon of observable near-field extension through the use of loudspeaker line arrays is well known in the art.

Another advantage of a loudspeaker line array system is that one can arrange the speakers at a specific angle and height to optimize the sound level output and achieve the desired coverage. The height of an array governs its directivity and the spacing of the individual elements in a second-order effect that determines the lobing structure of the line array. By properly arranging the line array speakers and articulating or curving the loudspeaker array in the vertical plane at a specific angle, one can provide excellent coverage for listeners seated in both the near and the far fields.

To reproduce the desired sound level and wider coverage in large buildings, such as, a large auditorium, a concert hall or similar large area, it is known that a plurality of accurately arranged loudspeakers may be mounted on the specially designed racks with other hanging equipment. Yet, there are notable disadvantages with the known multi-speaker based sound reproducing systems.

Many venue situations typically have more than one seating plane. Determining the optimum loudspeaker array configuration, and arranging such a configuration accordingly, are important. With the conventional systems, it has been difficult, for example, to adjust and maintain the splay angle between adjacent speakers. In addition, the angles between the line array speakers determine the overall curvature of the loudspeaker array system, and it is important to maintain the overall integrity of the loudspeaker array once suspended in the air. Depending on the particular seating plane, the loudspeakers must be deployed precisely and maintained in a specific vertical angle to avoid phase interference between the sounds from the adjacent loudspeakers. The conventional systems are not truly "rigid" in that the specific angles between the speakers cannot be maintained constant while the system is suspended or otherwise manipulated.

Another problem associated with the loudspeaker array systems known in the art is the difficulty of assembling, suspending and adjusting a plurality of loudspeakers in the desired configuration. Substantial elaborate preparation and labor are required to assemble and install the multiple loudspeakers in a large building such as an auditorium, concert hall or baseball park, etc. The installation time and cost become significant, especially in large-scale operations in which up to several tens of line arrays are to be installed.

Another disadvantage of the conventional loudspeaker array systems relates to the transportation of the line array loudspeakers from one location to another. The dimensions of the line array loudspeaker systems play a significant role in determining the number of transportation vehicles needed, and consequently it has a significant impact on the transportation and operation costs. Many conventional sound systems known in the art are designed without the dimensional considerations that are often critical in actual practice of loading and transporting the systems.

A need exists for line array loudspeakers that are easy to assemble, suspend and transport. In addition, a need exists for a loudspeaker array system that provides the ability to maintain the splay angle between the adjacent speakers and rigidly maintain the curvature of the line array system.

SUMMARY

A system is provided for suspending a plurality of line array loudspeakers. The suspension system includes a rigging bar that may be positioned on one or more sides of an array loudspeaker. In one example of one implementation of the suspension system, the rigging bar may extend along the entire length of at least one side of the loudspeaker. The rigging bar includes an engaging member, such as a pivotal member, positioned near one end of the rigging bar. The engaging member of the suspension system includes a free end capable of extending outwardly past the end of the rigging bar, and accordingly past the perimeter of the array loudspeaker to which the rigging bar is secured. The end of the rigging bar opposite the engaging member is further designed to releasably receive an engaging member. By way of example, the rigging bar may include a channel or other void at its receiving end for receiving an engaging member of an adjacent rigging bar.

The free end of the engaging member may further include at least one hole that aligns with holes in the receiving end of an adjacent rigging bar. The engaging member of one rigging bar may then be secured to an adjacent rigging bar by a release pin positioned to extend through the aligning holes of the engaging member and the receiving end of the rigging bar.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Figure 1:
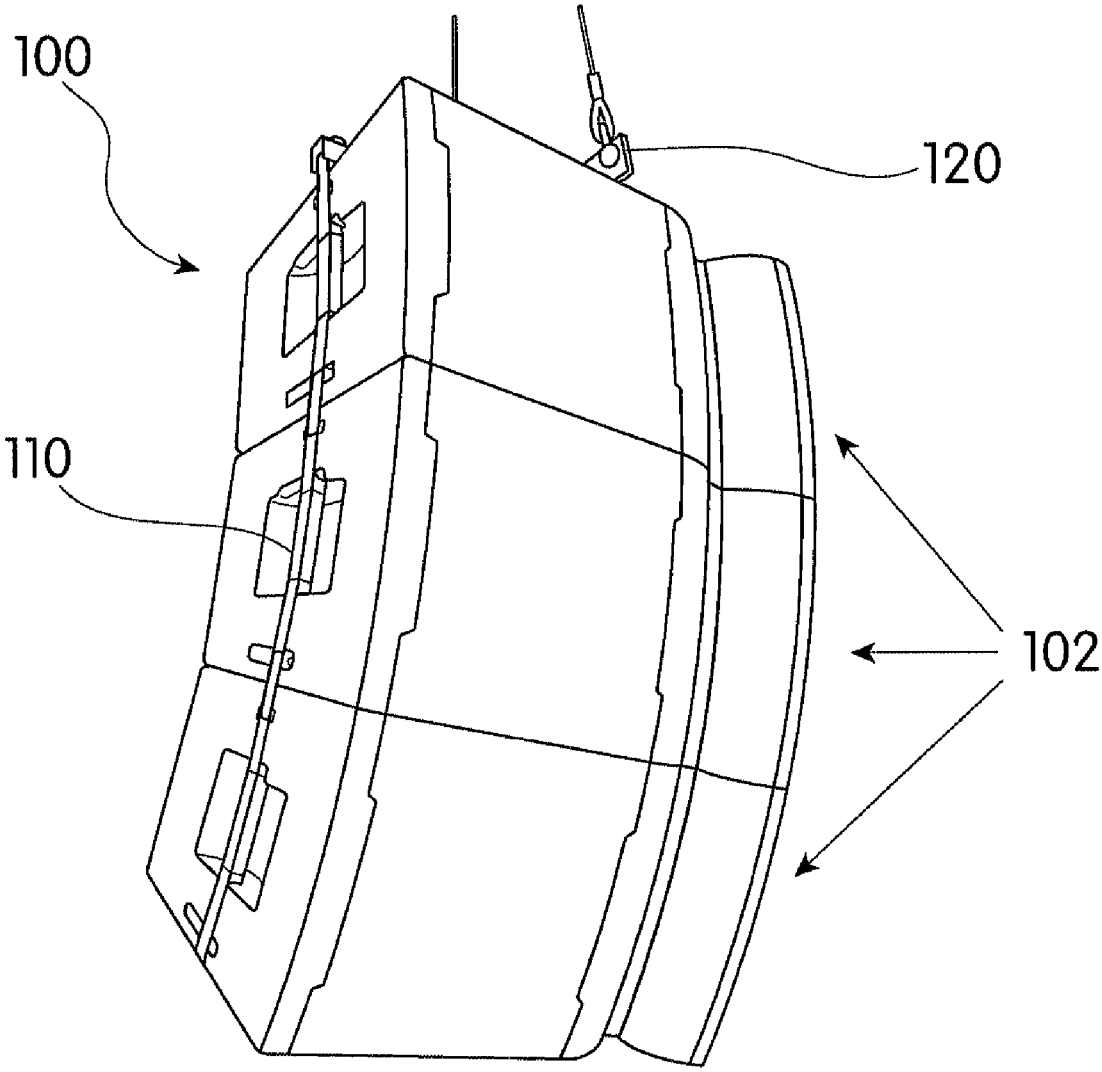
FIG. 1 is a perspective view of a loudspeaker array utilizing a suspension system of the invention.

Turning first to FIG. 1, FIG. 1 is a perspective view of a loudspeaker array 100 utilizing a suspension system of the invention. As illustrated by FIG. 1, a loudspeaker array 100 is a group, often of similarly sized, sound radiating sources or loudspeakers 102 that provide increased directivity at various frequencies. The directivity is determined by the height of an array while the spacing of the individual elements is a second-order effect that determines the lobing structure of the line array. Using a simple equation, one can determine the anticipated performance of differently-sized sound radiators and their spacing in relation to each other. To be useful in large-scale sound reinforcement settings, well-designed coverage for listeners seated in both the near and the far fields are important. For the far field coverage, a relatively straight array may radiate the sound level desired. But the near field coverage often requires some degree of curvature to provide uniformity of coverage over a wider vertical angle.

Figure 2:
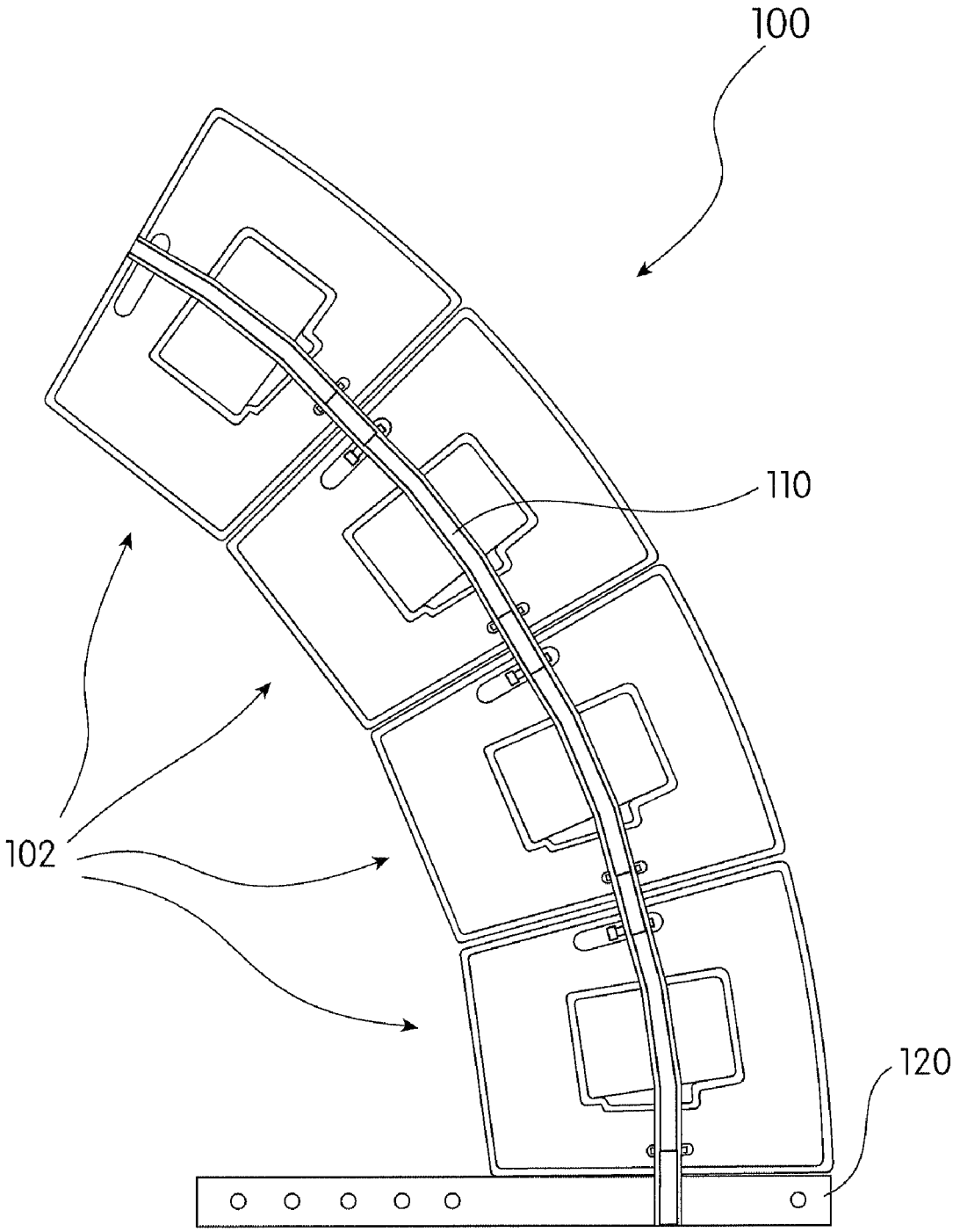
FIG. 2 is a side view of a ground-stacked loudspeaker array utilizing a suspension system of the invention.

FIG. 1 illustrates each array loudspeaker 102 having left (not shown) and right rigging frames 110 that allow the loudspeaker array 100 to be either suspended in the air, as illustrated by FIG. 1, or ground stacked, as illustrated by FIG. 2. As illustrated in FIGS. 1 and 2, each loudspeaker array 100 typically includes an array frame 120 that may be utilized to either hoist the loudspeaker array 100 in the air or function as a base support when ground stacked. Both the air-suspended and the ground stacked systems 100 may be articulated or curved to achieve the optimum sound radiation to a predetermined area.

Figure 3:
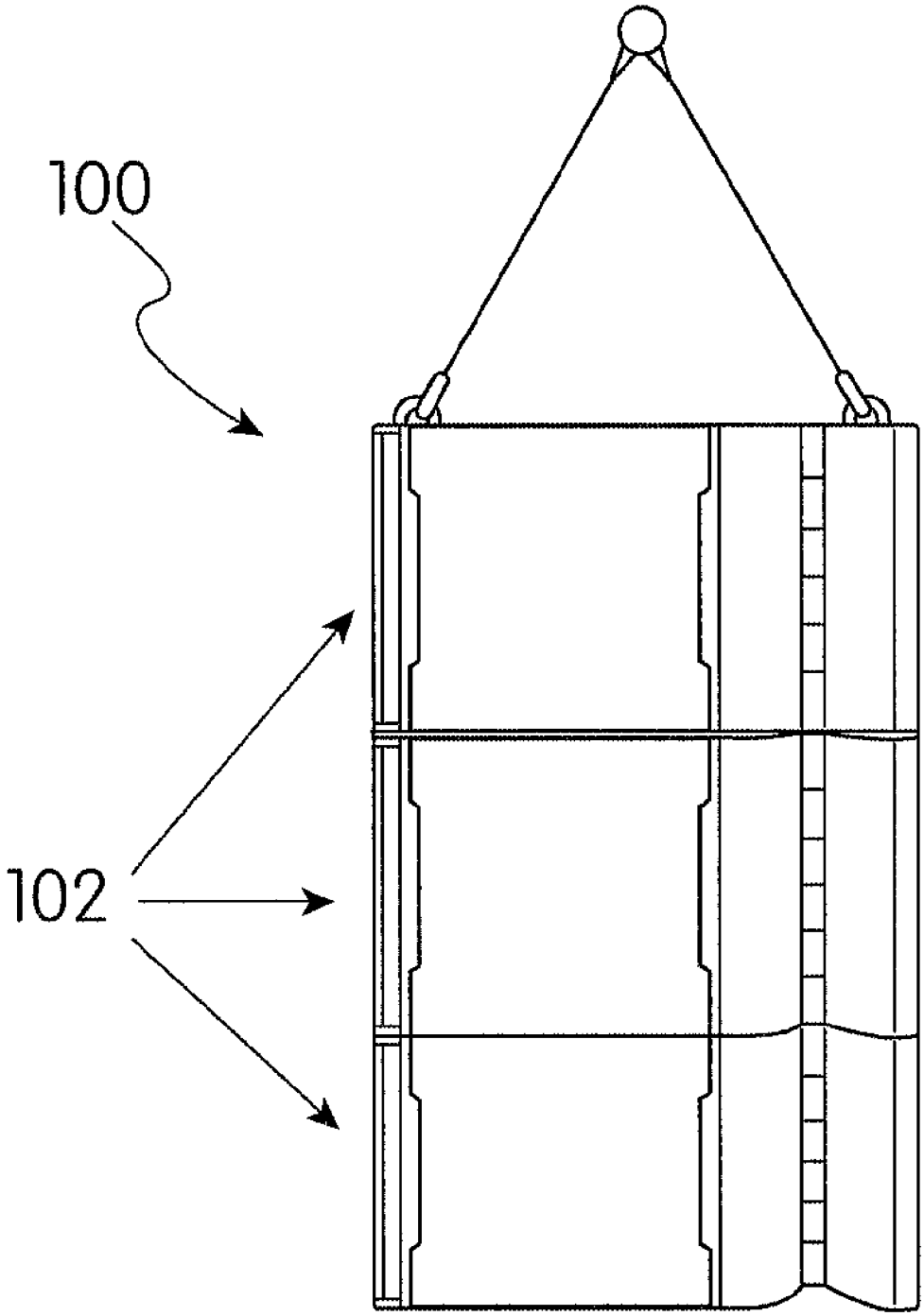
FIG. 3 is a front view of the loudspeaker array of FIG. 1.

To further illustrate the suspension system of loudspeaker array 100, FIG. 3 shows a front view of the loudspeaker array 100 of FIG. 1. As illustrated by FIG. 3, in this example loudspeaker array 100, the loudspeakers are two-way, line array loudspeakers 102 designed for use as part of a loudspeaker array. In the example illustrated in FIG. 3, three array loudspeakers 102 form the loudspeaker array 100.

Figure 4:
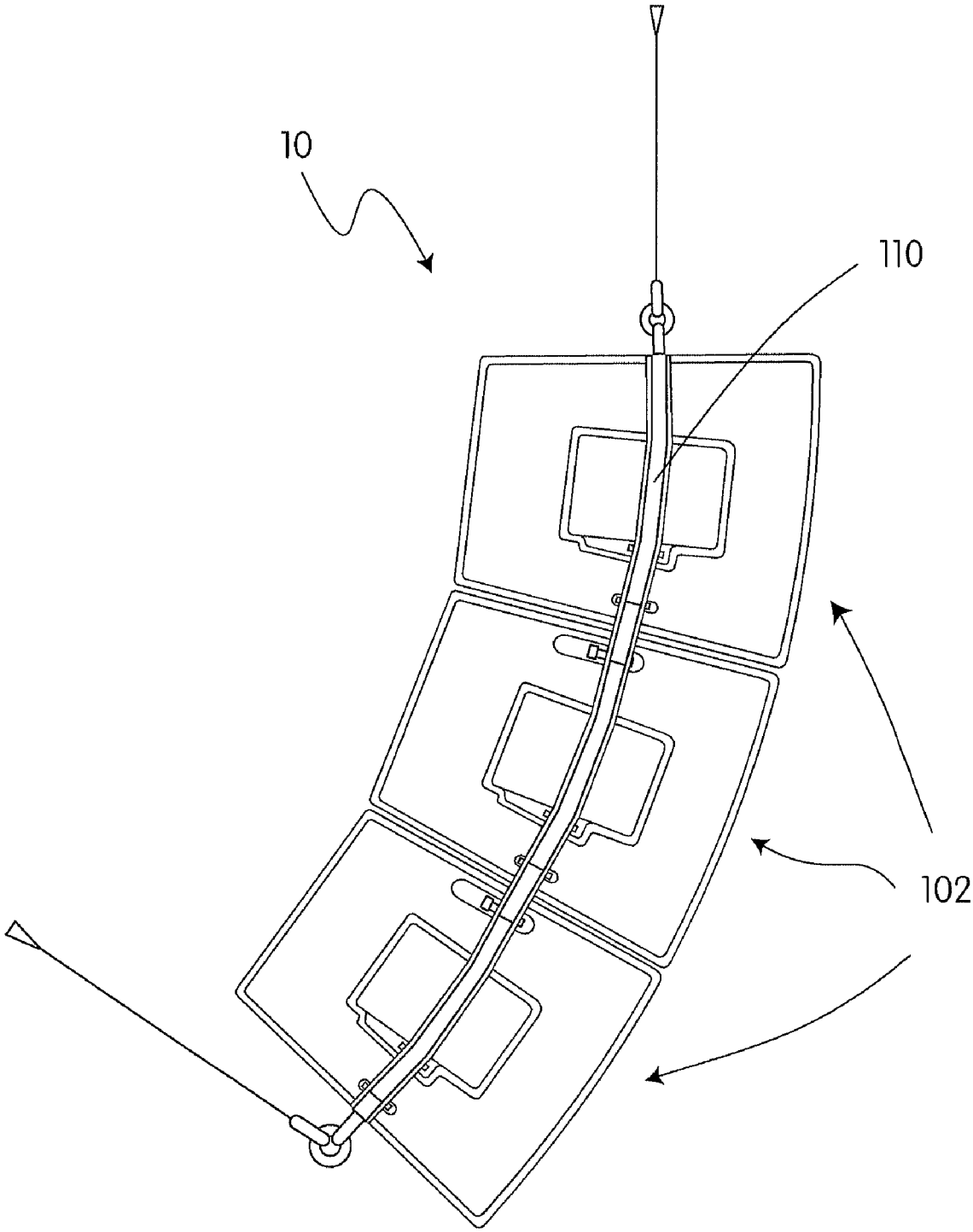
FIG. 4 is a side view of the loudspeaker array of FIG. 1.
Figure 5:
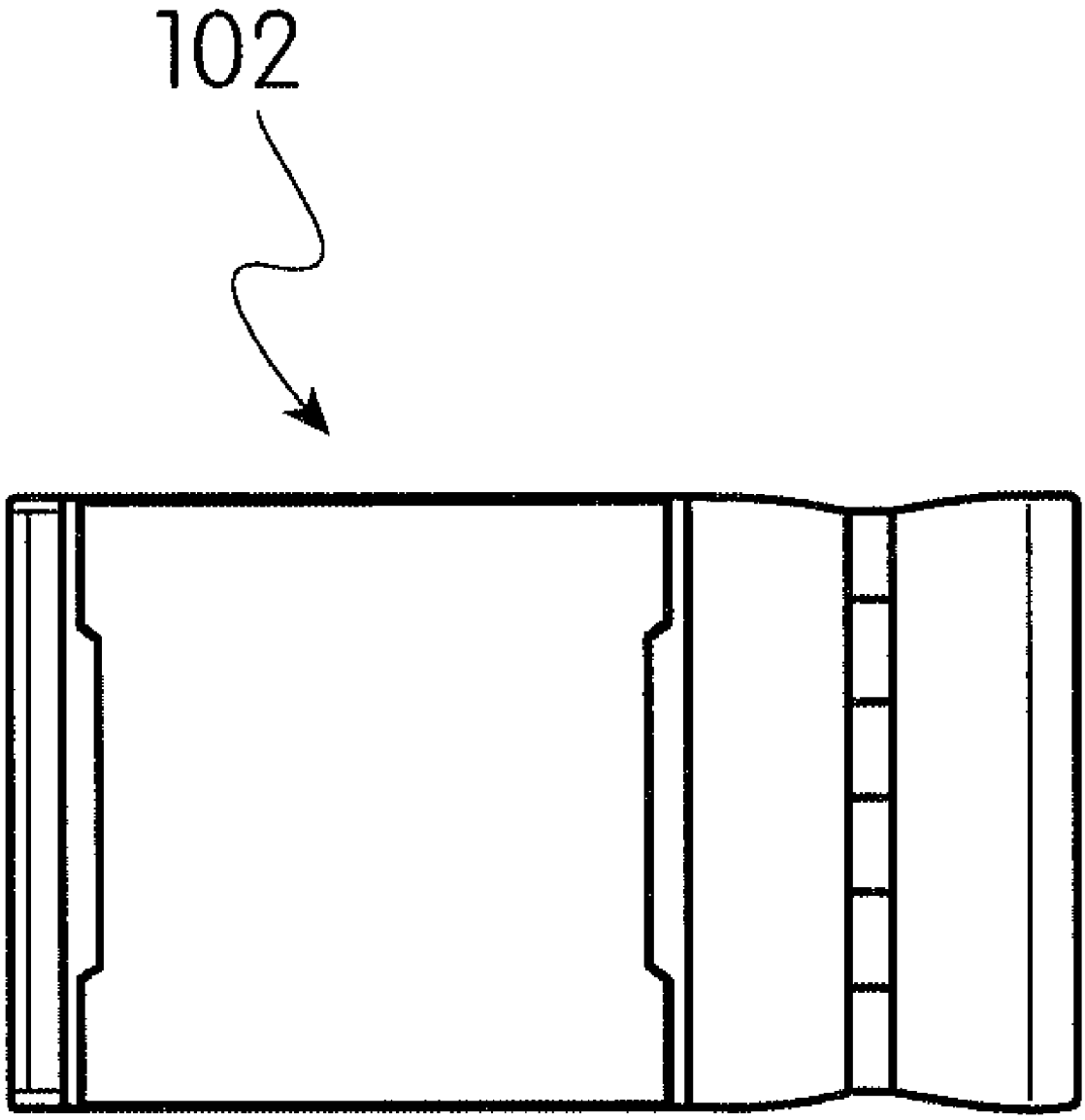
FIG. 5 is a front view of the one of the loudspeakers in the array of FIG. 1.
Figure 6:
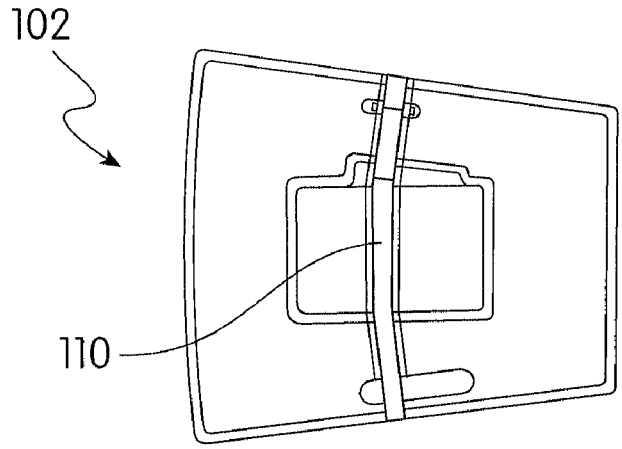
FIG. 6 is a side view of the loudspeaker of FIG. 5.
Figure 7:
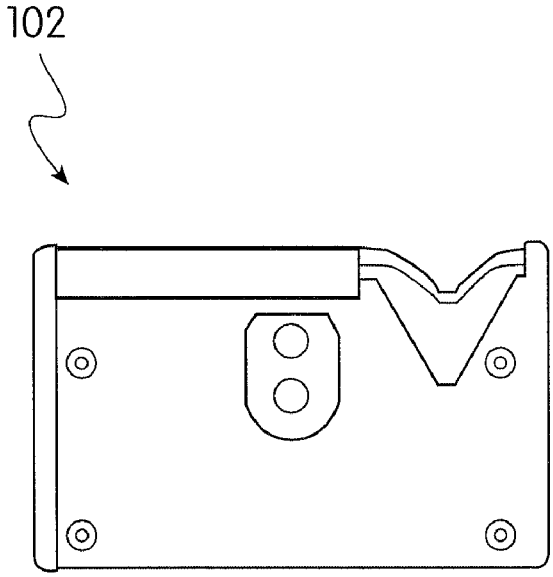
FIG. 7 is a bottom view of the loudspeaker of FIG. 5.
Figure 8:
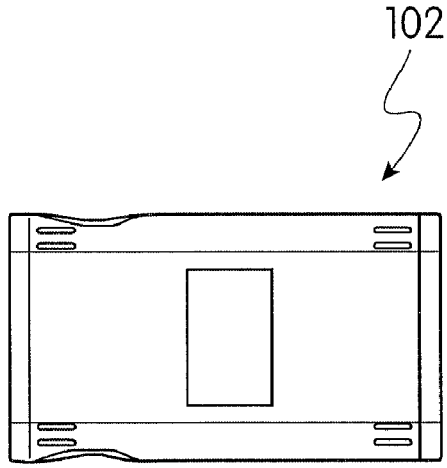
FIG. 8 is a rear view of the loudspeaker of FIG. 5.

FIG. 4 is a side view of the loudspeaker array of FIG. 1. As illustrated in FIG. 4, rigging frames 110 on the left (not shown) and right sides of the loudspeakers 102 are used to successively couple the loudspeakers 102 together. The line array loudspeakers 102 may be designed such that the loudspeaker array 100 has a predetermined curvature when loudspeakers are coupled in an array to provide uniformity of coverage over a wide vertical angle.

FIGS. 5, 6, 7 and 8 are front, side, bottom and rear views, respectively, of one of the line array loudspeakers 102 in the array 100 of FIG. 1. Although both sides of the loudspeaker 102 are not shown, each line array loudspeaker 102 has a left and right rigging frame 110 coupled on each side of the speaker. While in the illustrated examples, both sides of the loudspeaker 102 have a rigging frame 110 coupled to the side, those skilled in the art will recognize that for certain applications, it may be possible to form a loudspeaker array 100 having the rigging frame 110 coupled to only one of the sides of the loudspeakers 102.

Figure 9:
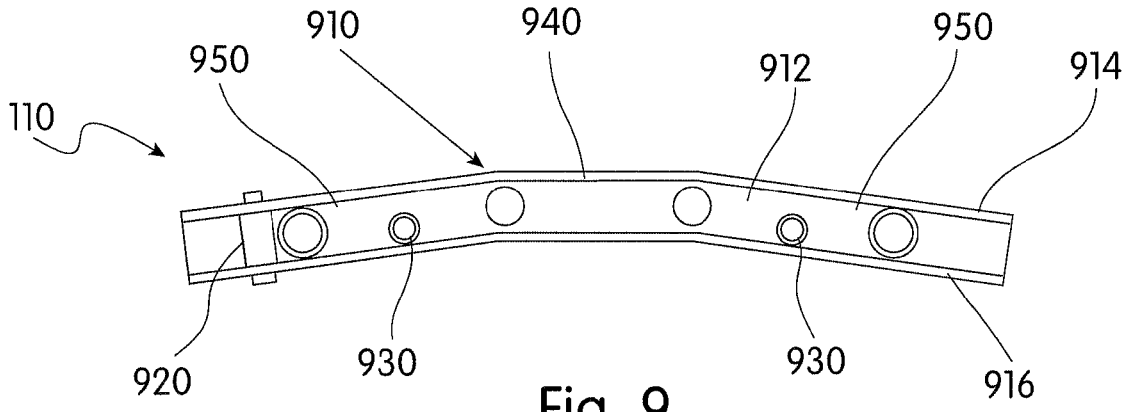
FIG. 9 is a top view of one example of a rigging frame utilized in the suspension system of the invention.

FIG. 9 is a top view of one example of one implementation of a rigging frame 110 utilized in the suspension system of a loudspeaker array, including, but not limited to, use in connection with arrays similar to the arrays 100 illustrated in FIGS. 1 & 2. As illustrated in FIG. 9, the rigging frame 110 includes a rigging bar 910 and a pivotal member 920 positioned near one end of the rigging bar 910. The rigging bar 910 may be made of any material capable of acting as a suspension member to support the coupling of the loudspeakers 102 (see FIGS. 1 & 2) comprising the loudspeaker array 100, including, but not limited to, metal, such as steel or aluminum. In the example illustrated in FIG. 9, the rigging bar 910 is a generally U-shaped bar or channel having a base portion 912 and first and second opposing sides 914, 916.

As further illustrated in FIG. 9, the rigging bar 910 may further include holes 930 positioned along the bottom or base 912 of the rigging bar 910 to secure the rigging bar 910 to a loudspeaker. Although the examples illustrated in the accompanying figures provide array loudspeakers having recessed channels along the sides of the loudspeakers for receiving the rigging bar 910, those skilled in the art will recognize that the rigging bar 910 may be secured directly against the sides of the loudspeakers 102 using screws or any other known means for mechanically mounting the rigging bar 910 to the loudspeaker.

Further, while in the illustrated designs, the rigging bar 910 is mounted on the sides of the loudspeakers 102 (See FIGS. 1

& 2), those skilled in the art will recognize that the configuration of the rigging bars 910 may be designed to allow the rigging frame 110 to attach at other locations on an array loudspeaker. In such case, the rigging bar 910 may attach, for example to the front or back of a loudspeaker 102, either in a recess designed to receive the rigging bar 910, or directly on the loudspeaker, without departing from the scope of the invention.

Also, as shown in FIG. 9, the rigging bar 910 is designed to extend across the side of a loudspeaker 102 at an angle that will align the channels of adjacent rigging bars 910, secured against opposing loudspeakers. In the illustrated example, the rigging bar 910 has a general straight central portion 940 and two opposing angular portions 950 extending from the central portion 940. The angle formed between the central portion 940 and each opposing angular portion 950 should be an angle necessary to align channels of adjacent rigging bars 910 when two loudspeakers with a rigging frame 110 are coupled. Those skilled in the art will recognize that the rigging bar 910 may be configured differently without departing from the scope of the invention. For example the rigging bar 910 may be in the form of a V-shaped bar, may include a series of more than three angular sections, or may include both rounded and straight sections. As further illustrated below, in the example configuration, the central portion 940 may serve as a handle for the loudspeaker. Configurations where the rigging bar 910 may serve a dual purpose, such as functioning as a handle, may be desirable.

Figure 10:
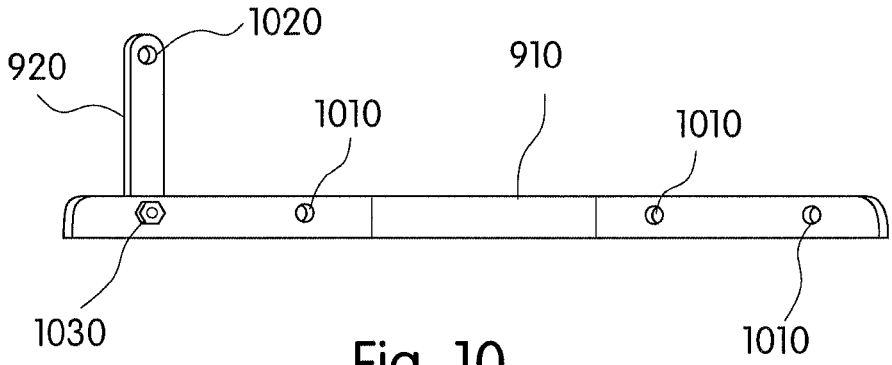
FIG. 10 is a side view of the rigging frame of FIG. 9.

FIG. 10 is a side view of the rigging frame of FIG. 9. As illustrated in FIG. 10, the rigging bar 910 further includes four pairs of opposing holes 1010, one set on the first side 914 of the rigging bar 910 and an opposing set (not shown) on the second side 916 of the rigging bar 910. As illustrated in FIG. 10, one pair of opposing holes 1010 positioned on either end of the rigging bar 910 is designed to receive the pivotal member 920 of the rigging frame 110. As illustrated, the pivotal member 920 may be secured within the channel of the rigging bar 910 by a pin 1030 that extends through a pair of opposing holes 1010 near one end of the rigging bar 910 and through one of the two holes 1020 each positioned at one end of the pivotal member 920 (see FIG. 12). As further illustrated below, the pivotal member 920 is secured to the rigging bar 910 in a manner that allows the pivotal member 920 to rotate generally 180 degrees to allow the pivotal member 920 to be stored within the channel of the rigging bar 910 or to extend outward away from the rigging bar to allow the pivotal member 920 to rest, at least partially, within the channel of an adjacent rigging bar 910.

Figure 11:
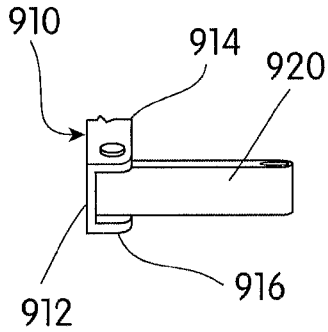
FIG. 11 is a front view of the rigging frame of FIG. 9.

By way of example, FIG. 10 shows the pivotal member 920 extending upward, generally perpendicular to the rigging bar 910. Because the pivotal member 920 is affixed to the rigging bar 910 in a manner that allows the pivotal member 920 to rotate, the pivotal member can rotate in the clock-wise direction, toward the interior of the rigging bar 910. As illustrated in FIG. 11, which is a front view of the rigging frame 110 of FIG. 9, the width of the pivotal member 920 is less that the width between the first side 914 and second side 916 of the rigging bar 910. Thus, when the pivotal member 920 is rotated clockwise (in accordance with the illustration in FIG. 10), the pivotal member 920 may lay flat within the channel of the rigging bar 910, with the length of the pivotal member 920 positioned along the bottom or base 912 of the rigging bar 910.

As will be further described below, another opposing set of holes 1010 may be positioned in the sides 914 and 916 of the rigging bar 910 that aligns with the top opening 1020 in the pivotal member 920. In this manner, a pin, such as a quick release pin, may be positioned through the top opening 1020 in the pivotal member 920 via an opposing set of holes in the sides of the rigging bar 910 to secure the pivotal member to the rigging bar 910 when the rigging frame 110 is not in use, for example, during transportation.

Alternatively, when the pivotal member 920 is rotated counter-clockwise, according to the view in FIG. 10, the pivotal member 920 may lay partially within the channel of the rigging bar 910. A portion of the pivotal member 920 will then extend outward, following the direction of the rigging bar 910, past the end of the rigging bar 910. In this manner, when the rigging bar 910 is positioned next to an adjacent rigging bar 910, the opening at the far end of the pivotal member 920 may be positioned to align with a set of holes 1010 near the end of the adjacent rigging bar 910. A release pin, or other securing mechanism, may then extend through the holes 1010 in the adjacent rigging bar 910 and the aligned opening 1020 in the pivotal member 920 to mechanically secure one rigging bar 910 to an adjacent rigging bar 910.

Figure 12:
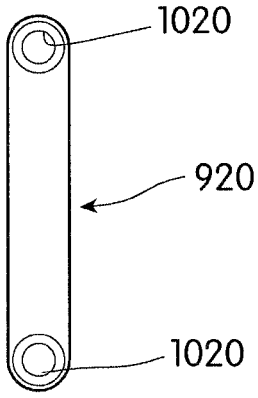
FIG. 12 is a side view of the pivotal member of the rigging frame of FIG. 9 separated from the rigging frame.

FIG. 12 is a side view of the pivotal member 920 of the rigging frame 110 of FIG. 9 separated from the rigging frame 110. As illustrated in FIG. 12, the pivotal member 920 may be a generally elongated member having openings 1020 positioned at each end of the member 920 along the width of the member 920. As explained above, one opening 1020 is for pivotally attaching the pivotal member 920 to the rigging bar 910 and the other opening 1020 may be for mechanically securing the pivotal member 920 to a second rigging bar 910 positioned adjacent to the rigging bar 910 to which the pivotal member 920 is pivotally attached.

Figure 13:
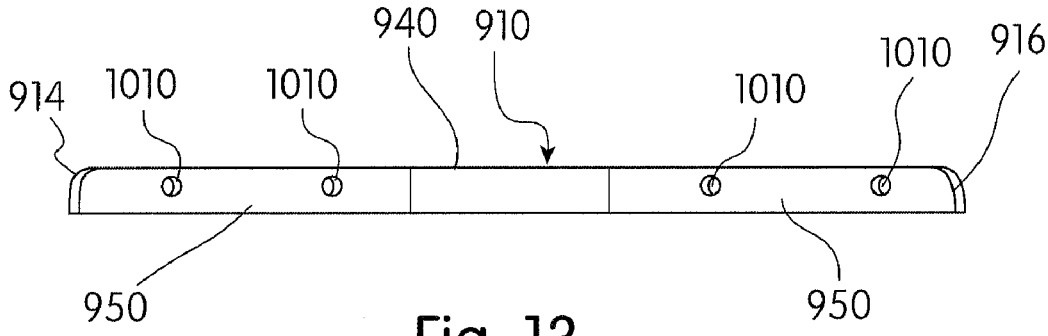
FIG. 13 is a side view of the rigging bar of the rigging frame of FIG. 9 absent the pivotal member.

FIG. 13 is a perspective side view of the rigging bar 910 of the rigging frame 110 of FIG. 9 absent the pivotal member 920. In this view, the three sections of the rigging bar 910 are illustrated—the central section 940 and the two angular sections 950 (See FIG. 9). Further, the four sets of opposing holes 1010 in the sides 914, 916 of the rigging bar 910 are illustrated.

In operation, as illustrated in FIGS. 14-18, a line array loudspeaker 1410 may be designed with a recessed side channel for receiving the rigging frame 110. By designing the line array loudspeaker 1410 with a recessed side panel for receiving the rigging frame 110, the rigging frame 110 may be recessed in the side of the line array loudspeaker 1410 so that it is flush with the side of the loudspeaker 1410. As previously discussed, those skilled in the art will recognize that it is not necessary for an array loudspeaker 1410 to have recessed side channels for receiving the rigging bar 910 to utilize the rigging frame 110. The rigging bars 910 of the rigging frame 110 may be attached directly to the sides of line array loudspeaker 1410 such that the rigging bars 910 extend outward from the sides of the loudspeaker 1410, as opposed to being flush with the sides of the loudspeaker 1410.

Figure 14:
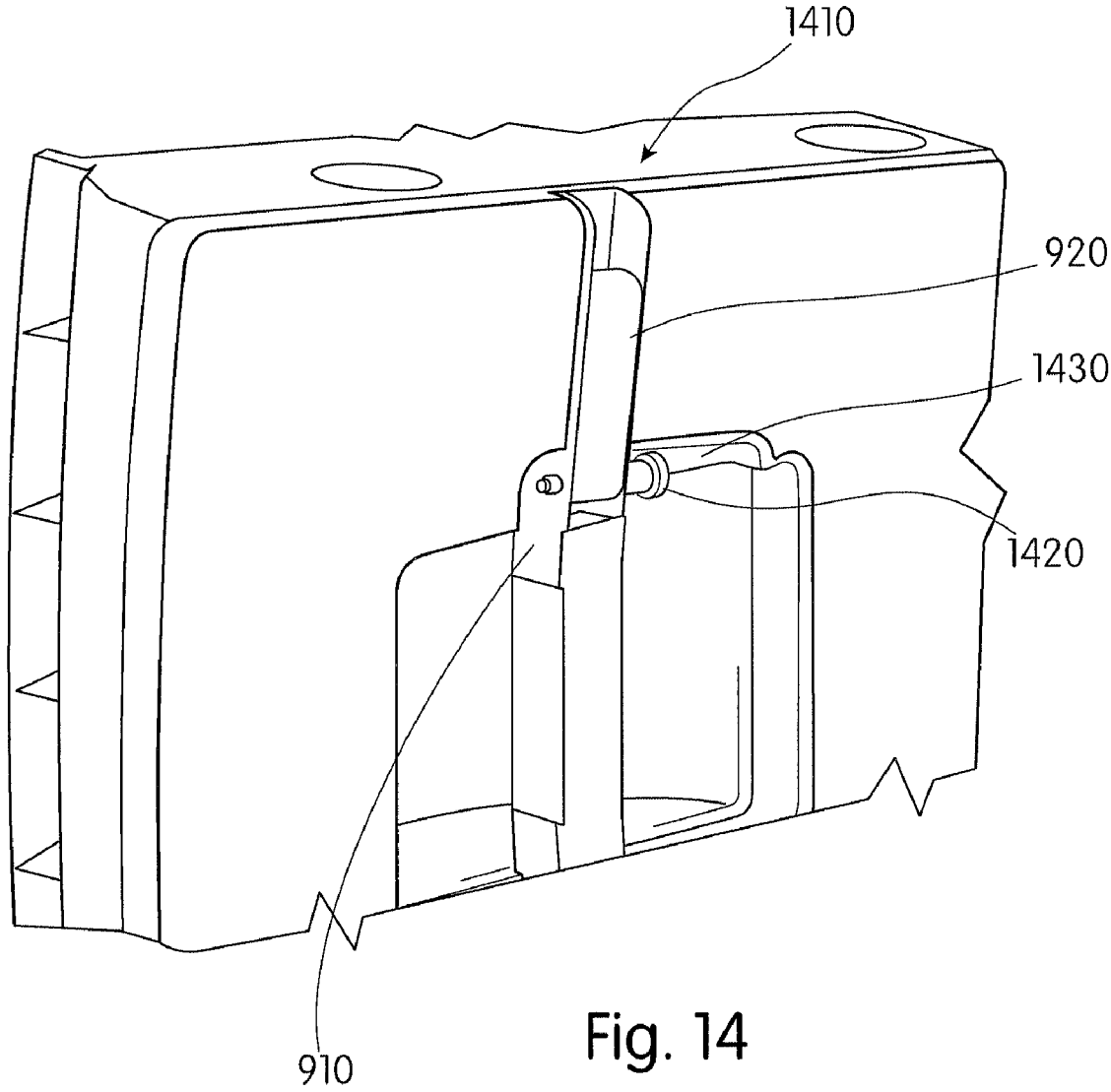
FIG. 14 is a perspective side view of a portion of an array loudspeaker utilizing a rigging frame and illustrating a pivotal member in a stored position.

As illustrated in FIG. 14, the pivotal member 920 of the rigging frame 110 may be stored flat within the channel of the rigging bar 910 when the loudspeaker 1410 is not coupled with other array loudspeakers, for example, during transportation, storage, or use not as part of a line array. To maintain the pivotal member 920 within the perimeter of the loudspeaker 1410 and/or the rigging bar 910, the pivotal member 920 may be secured within the channel of the rigging bar 910 using a releasable lock or releasing pin 1420 extending through aligning holes 1010 (FIG. 12) in the sides of the rigging bar 910 and an opening 1020 (FIG. 11) located at the free end of the pivotal member 920.

When the rigging bar 910 is recessed in the side of the loudspeaker 1410, a recessed channel or section 1430 may also be provided to allow for the insertion and removal of the release pin 1420 into the pivotal member 920 when in its stored position. Those skilled in the art will recognize that it is not necessary to utilize a release pin 1420 to store the pivotal member 920 or to maintain the pivotal member 920 in a stored position. The release pin 1420 used to maintain the pivotal member 920 in its stored position may, however, also be used to secure the pivotal member 920 in its locked position to adjacent rigging bars 910 to couple the loudspeakers 1410 in a line array. Providing aligning holes to allow the release pin 1420 to secure the pivotal member 920 to the rigging bar 910 in a stored position, while not necessary, may help to prevent the loss of release pins 1420 utilized in the rigging frame 110.

Figure 15:
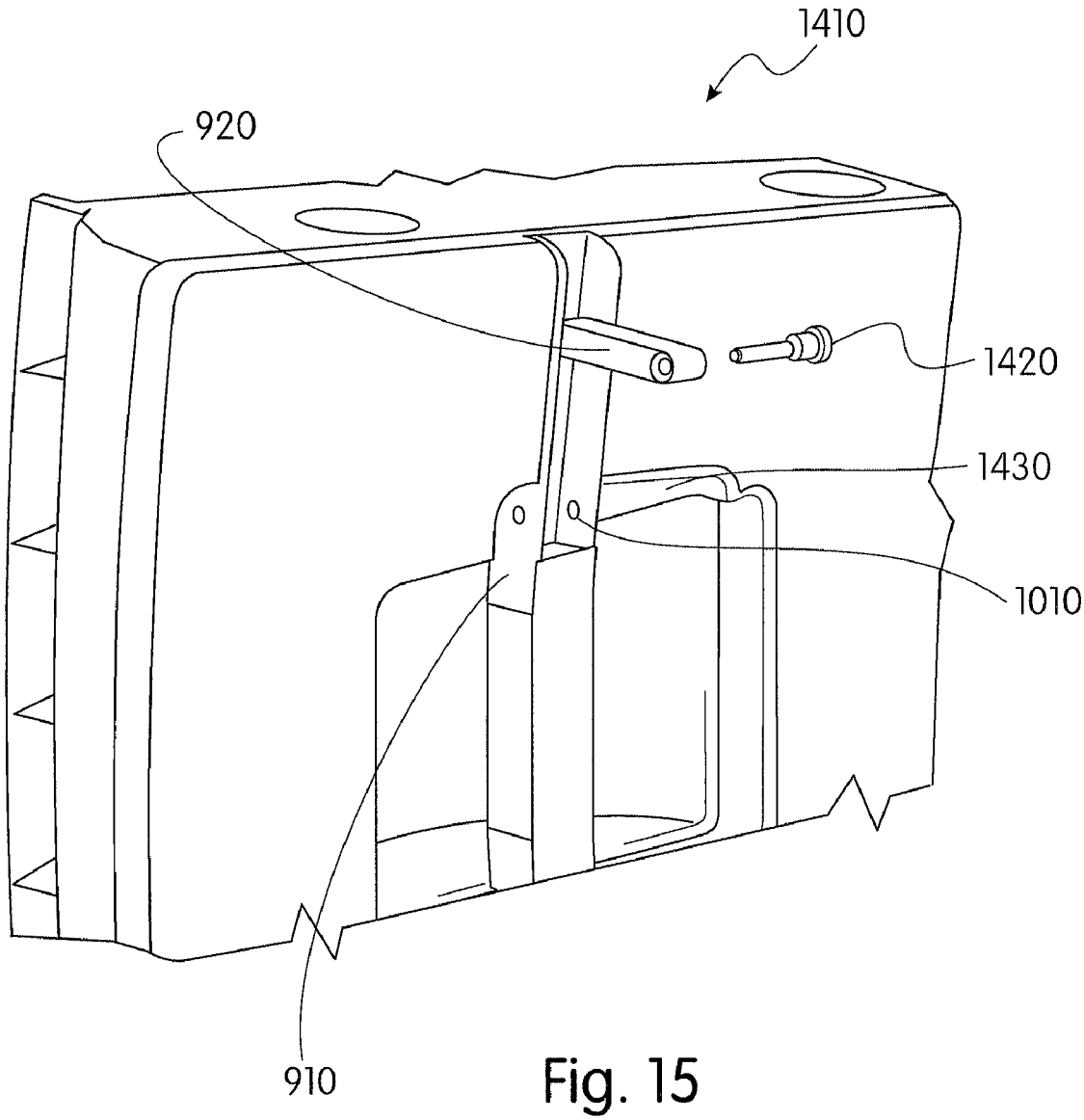
FIG. 15 is a perspective side view of a portion of an array loudspeaker utilizing a rigging frame and illustrating the quick release pin removed from the pivotal member of the rigging frame.

FIG. 15 is a perspective side view of the array loudspeaker 1410 in FIG. 14 illustrating the quick release pin 1420 removed from the pivotal member 920 of the rigging frame 110. In operation, to secure one line array loudspeaker 1410 to another, the pivotal member 920, if in its stored position, is moved from its stored to its locking position. FIG. 15 illustrates the pivotal member 920 being rotated toward the end of the side of the loudspeaker 1410 to its locking position. In this example, the release pin 1420 is shown removed from the pivotal member 920.

Figure 16:
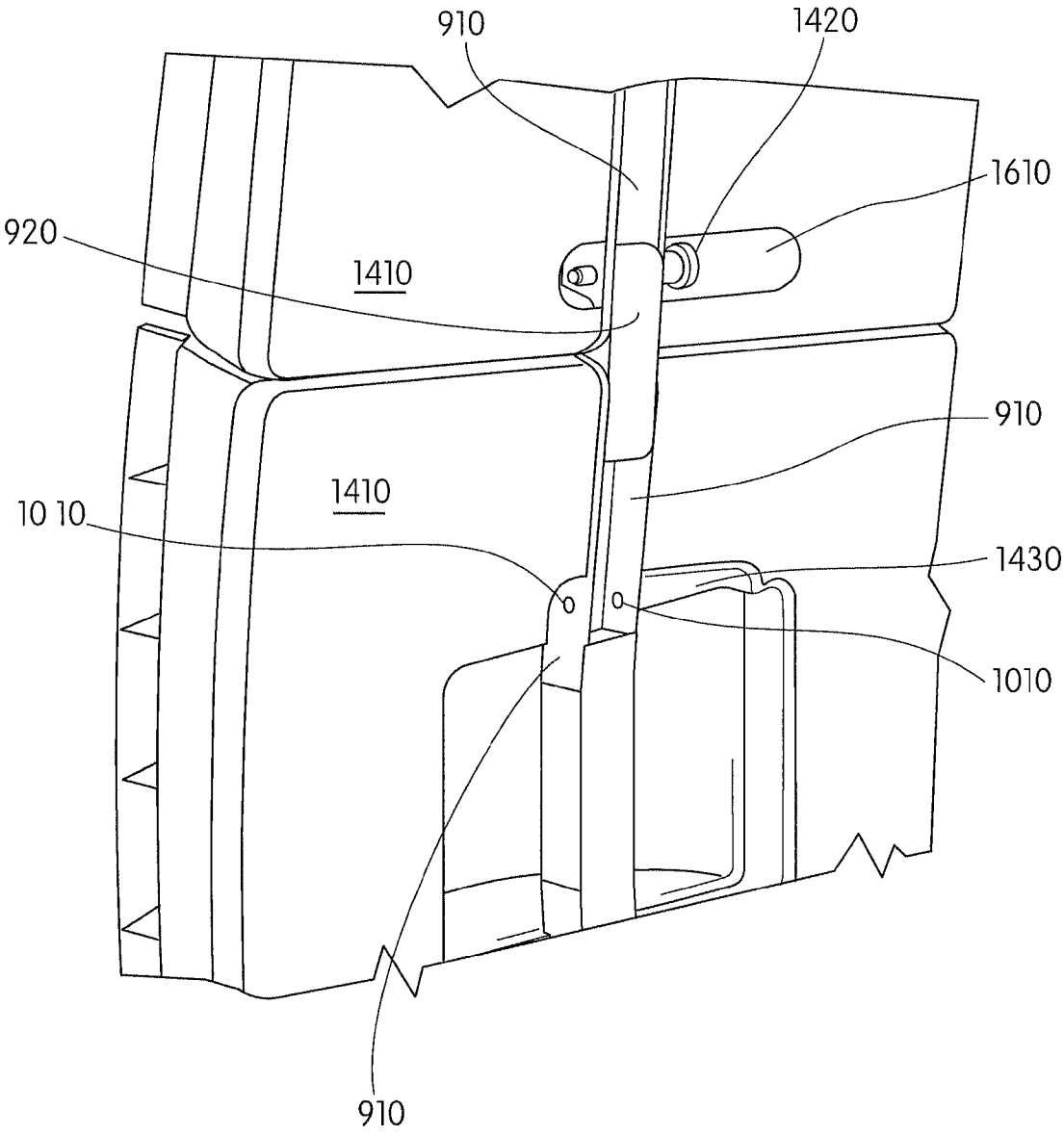
FIG. 16 is a perspective side view of a portion of an array loudspeaker stacked against another array loudspeaker and illustrating the pivotal member of the rigging frame locked to the rigging bar of the rigging frame of the adjacent loudspeaker.

FIG. 16 is a perspective side view of the array loudspeaker 1410 in FIG. 14 stacked against an adjacent array loudspeaker 1410 and illustrating the pivotal member 920 of the rigging frame 110 locked to the rigging bar 910 of the adjacent loudspeaker 1410. As illustrated in FIG. 16, when positioned adjacent to another loudspeaker 1410, the channels of the rigging bars 910 of each loudspeaker 1410 should align. In this manner, when the pivotal member 920 is rotated into its locking position, the free end of the pivotal member 920 will be positioned with the channel of the rigging bar 910 of the coupled loudspeaker 1410. Once the pivotal member 920 is positioned within the channel of the aligning rigging bar 910 of the adjacent loudspeaker, the pivotal member 920 may be secured to the adjacent rigging bar 910 using a release pin 1420, which may be the same release pin 1420 used to maintain the pivotal member 920 in its stored position (as in FIG. 14).

As illustrated, the rigging bars 910 are designed with a pair of opposing holes at the end of the rigging bar 910 opposite the end of the rigging bar 910 where the pivotal member is located, that align with the opening 1020 of the free end of the pivotal member 920 when two loudspeakers 1410 utilizing the rigging frame 110 are coupled in a loudspeaker array.

Figure 17:
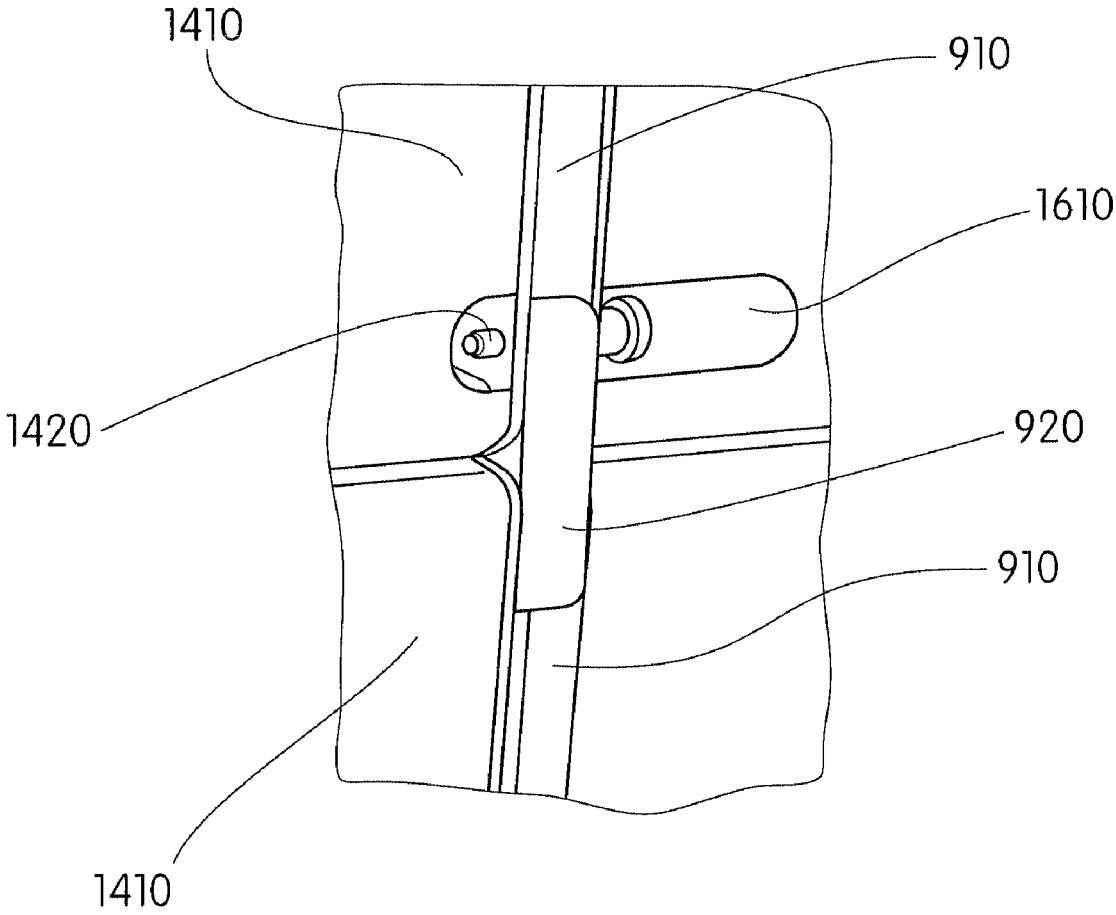
FIG. 17 is perspective side view of the rigging frames of two adjacent array loudspeakers secured to one another.

Similar to the recessed channel 1430, if the rigging frame 110 is recessed in the side panel of a loudspeaker 1410, a recessed area or channel 1610 is provided to allow for the insertion and removal of the release pin 1420 to mechanically secure a pair of speakers 1410 utilizing the rigging frame 110. FIG. 17 provides a close-up perspective side view of the section of the rigging frames 110 that provides for two adjacent array loudspeakers 1410 to be releasably locked to one another in a loudspeaker array.

Figure 18:
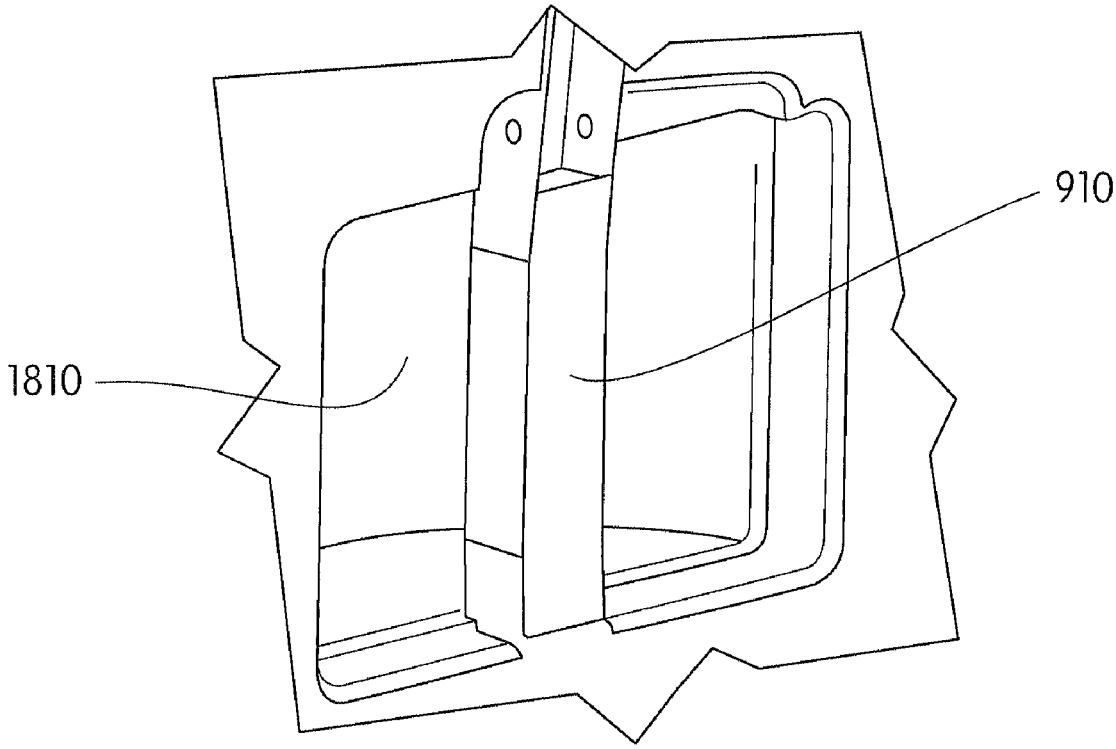
FIG. 18 is a perspective side view of a portion of a loudspeaker illustrating how the rigging frame may function as a handle positioned on the side of an array loudspeaker.

FIG. 18 is a perspective side view illustrating a further recess 1810 in the side of the loudspeaker that provides for the rigging bar 910 to serve as a handle positioned on the side of an array loudspeaker. Optionally, the portion of the rigging bar 910 that is accessible for use as a handle by the recess may be designed as a handle, i.e., designed for gripping. For example, the handle portion may be wrapped with foam or may include an additional gripping structure.

Figure 19:
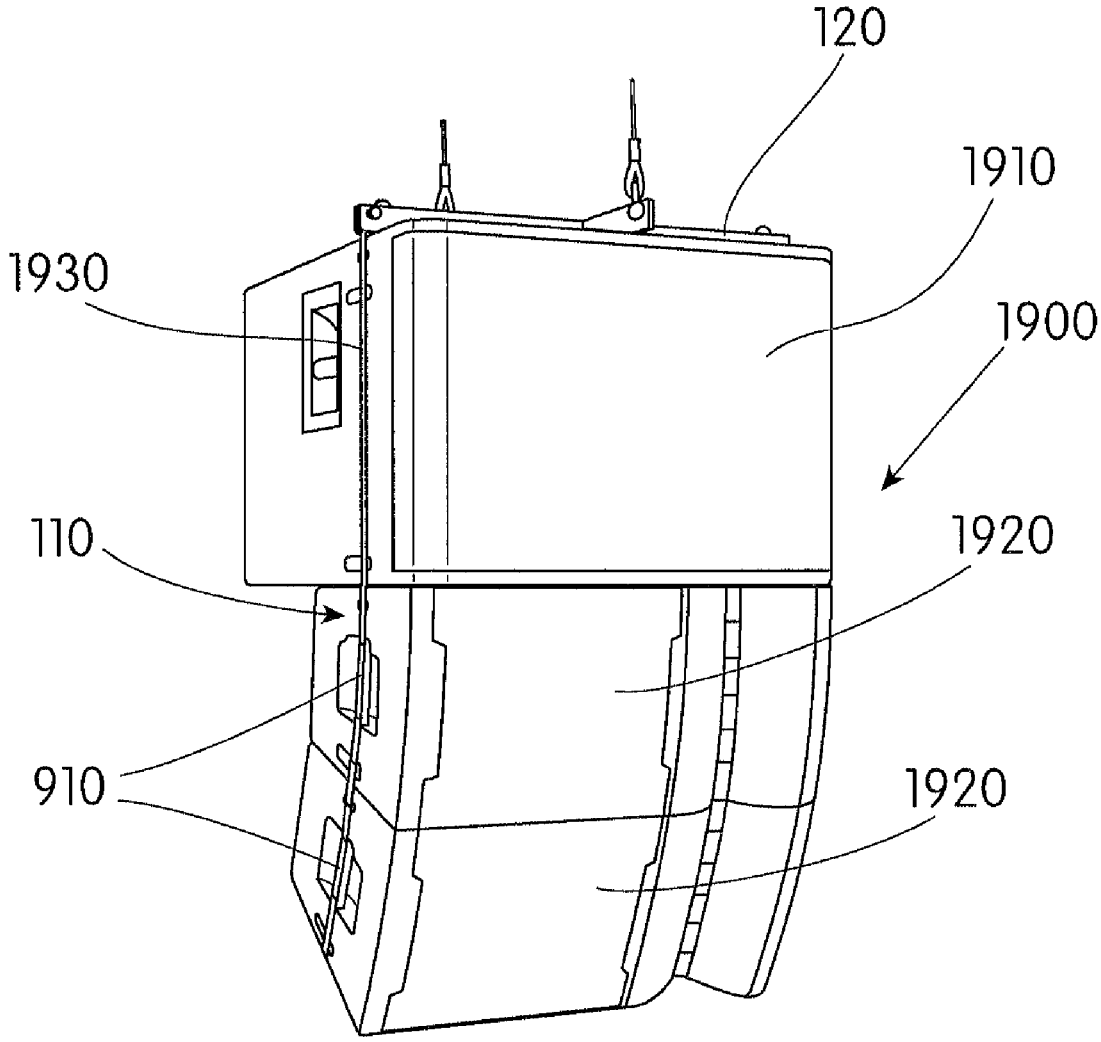
FIG. 19 is a perspective view of another implementation of a loudspeaker array utilizing a suspension system of the invention.

FIG. 19 is a loudspeaker array 1900 utilizing an array frame 120 designed for use in connection with the rigging frame 110. As previously discussed, a typical loudspeaker array may include at least one, but sometimes two, array frames 120. When included, a second array frame 120 may be utilized to allow the loudspeaker array to be a suspended array, using an array frame 120 secured to the first or top loudspeaker in the array, as shown in FIG. 19, or a ground-stacked array, using an array frame 120 secured to the bottom or last loudspeaker in the loudspeaker array (see FIG. 2).

As illustrated by FIG. 19, a loudspeaker array 1900 may include a loudspeaker 1910 of a different size than the other loudspeakers 1920 in the array 1900, in which case a rigging bar 1930 of a different configuration than other rigging bars 910 in the rigging frame 110 may need to be utilized in connection with such differently sized loudspeaker 1910. FIG. 19 illustrates the use of a rigging bar 1930 of relatively straight design used to couple the top loudspeaker 1910 to the array 1900. Further, the array frame 120 is then coupled atop the top loudspeaker 1910 via the rigging bar 1930 in a similar manner as adjacent rigging bars 910 are mechanically secured to one another, as further described below.

Figure 20:
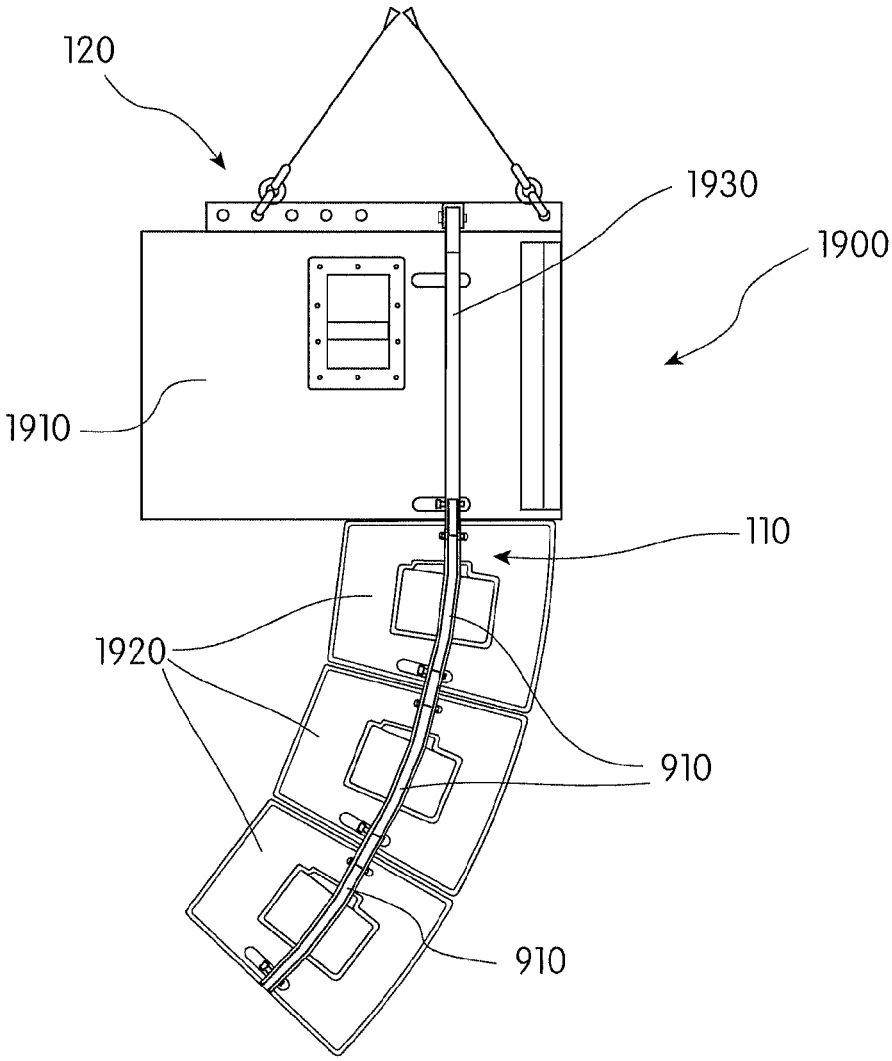
FIG. 20 is a side view of the loudspeaker array in FIG. 19.

FIG. 20 is a side view of the loudspeaker array 1900 in FIG. 19 further illustrating the loudspeaker array 1900, the rigging frame 110, the array frame 120, the inclusion of a loudspeaker of varying size 1910, the different rigging bar design configurations 1930 and 910, and the connection between the rigging frame 110 and the array frame 120. While FIG. 20 shows the array frame 120 secured against the top of a loudspeaker 1930 of a different shape than the rest of the loudspeakers in the loudspeaker array, the array frame 120, as shown in FIG. 21, may also be positioned atop a loudspeaker, similar to the uniformly sized loudspeakers 1920, in the loudspeaker array 1900.

Figure 21:
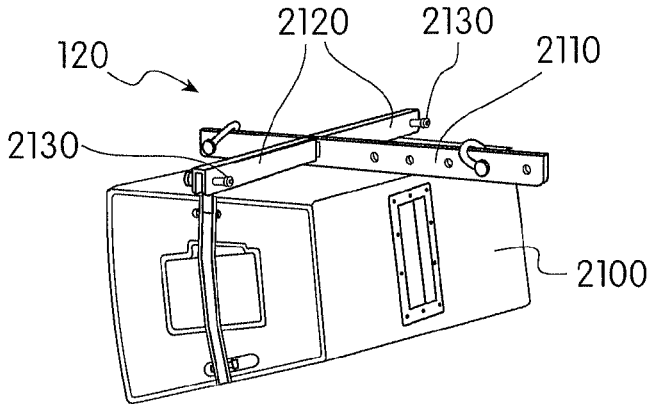
FIG. 21 is a top perspective view of a loudspeaker having an array frame affixed to the loudspeaker.

FIG. 21 is a top perspective view of a two-way, line array loudspeaker 2100 having an array frame 120 secured atop the loudspeaker 2100. As illustrated in FIG. 21, and as further illustrated in FIGS. 22-28, the array frame 120 includes a center frame 2110, two side aims 2120 and quick release pins 2130.

Figure 22:
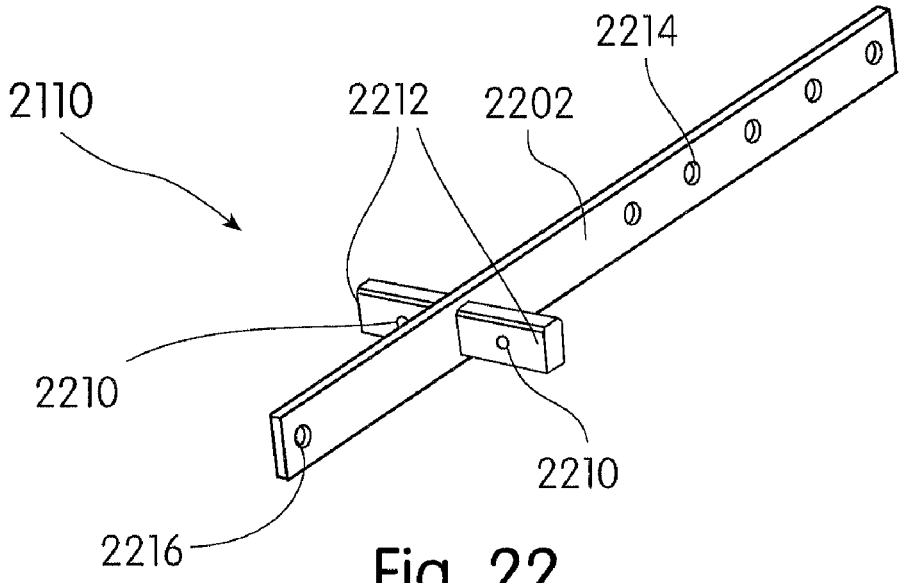
FIG. 22 is top perspective view of one example of one embodiment of an array frame for use in connection with the suspension system of the invention.

FIG. 22 is top perspective view of one example of a center frame 2110 of an array frame 120 designed for use with the rigging frame 110. In this example, the array frame 120 is illustrated with the two side arms 2120 (FIG. 21) detached from the center frame 2110. Those skilled in the art will, however, recognize that the array frame 120 may be designed such that the center frame 2110 and arms 2120 are one integral piece, among other varying designs.

The array frame 120 may be made of metal, such as aluminum or steel alloy. The center frame 2110 of the illustrated example of an array frame 120 includes an elongated bar 2202 having opposing cross side bars 2212 for securing the opposing side arms 2120 to the center frame 2110. The cross side bars 2212 include holes 2210 for receiving a pin, such as a release pin (not shown), to secure the side arms 2120 to the center frame 2110 via the side bars 2212. As illustrated further below, the side thins 2120 include a pair of holes that align with the holes 2210 in the side bars 2212 to secure the side arms 2120 to the center frame 2110. Further, the center frame 2110 includes a plurality of holes 2214 in the rear portion of the center frame 2110 and one hole 2216 in the front portion of the center frame 2110 for fitting shackles 2810 (FIG. 28) for suspending the loudspeaker array in the air.

Figure 23:
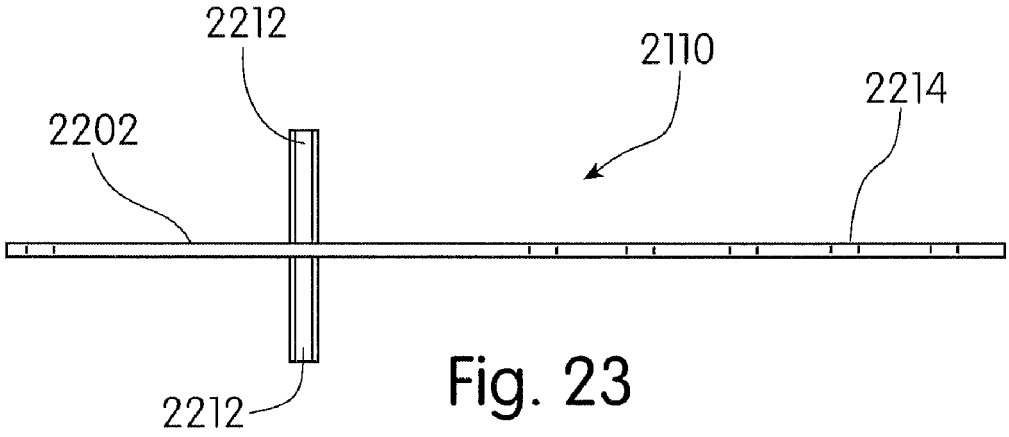
FIG. 23 is a top view of the array frame of FIG. 22.
Figure 24:
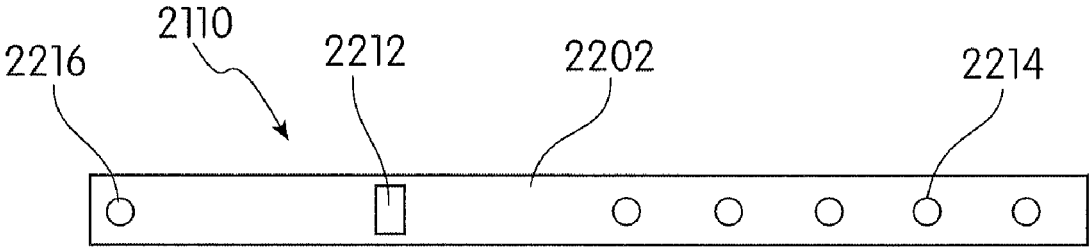
FIG. 24 is a side view of the array frame of FIG. 22.

FIG. 23 is a top view of the center bar 2110 of array frame 120 of FIG. 22. This view illustrates the opposing side bars 2212 extending outward, perpendicular to the elongated bar 2202 of the center frame 2110. FIG. 24 is a side view of the array frame of FIG. 22. FIG. 24 illustrates one side bar 2212 extending outwardly in the same plane defined by the width of the elongated bar 2202 of the center frame 2110. This view also shows the plurality of holes 2214 in rear portion of the center frame 2110 and the one hole 2216 in the front portion of the center frame 2110 for receiving shackles 2810 (FIG. 28) to suspend the loudspeaker array.

Figure 25:
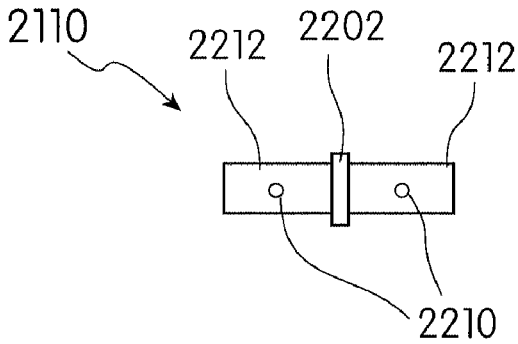
FIG. 25 is a front view of the array frame of FIG. 22.

FIG. 25 is a front view of the center frame 2110 of FIG. 22. FIG. 25 illustrates the holes 2210 positioned in the side bars 2212 extending from the elongated bar 2202 of the center frame 2110. The holes 2210 in the side bar 2212 are positioned to align with corresponding holes in the side arms 2120. Once aligned, a pin (not shown), such as a release pin, may be positioned through the aligned holes 2210 to secure the side arms 2120 to the center frame 2110.

Figure 26:
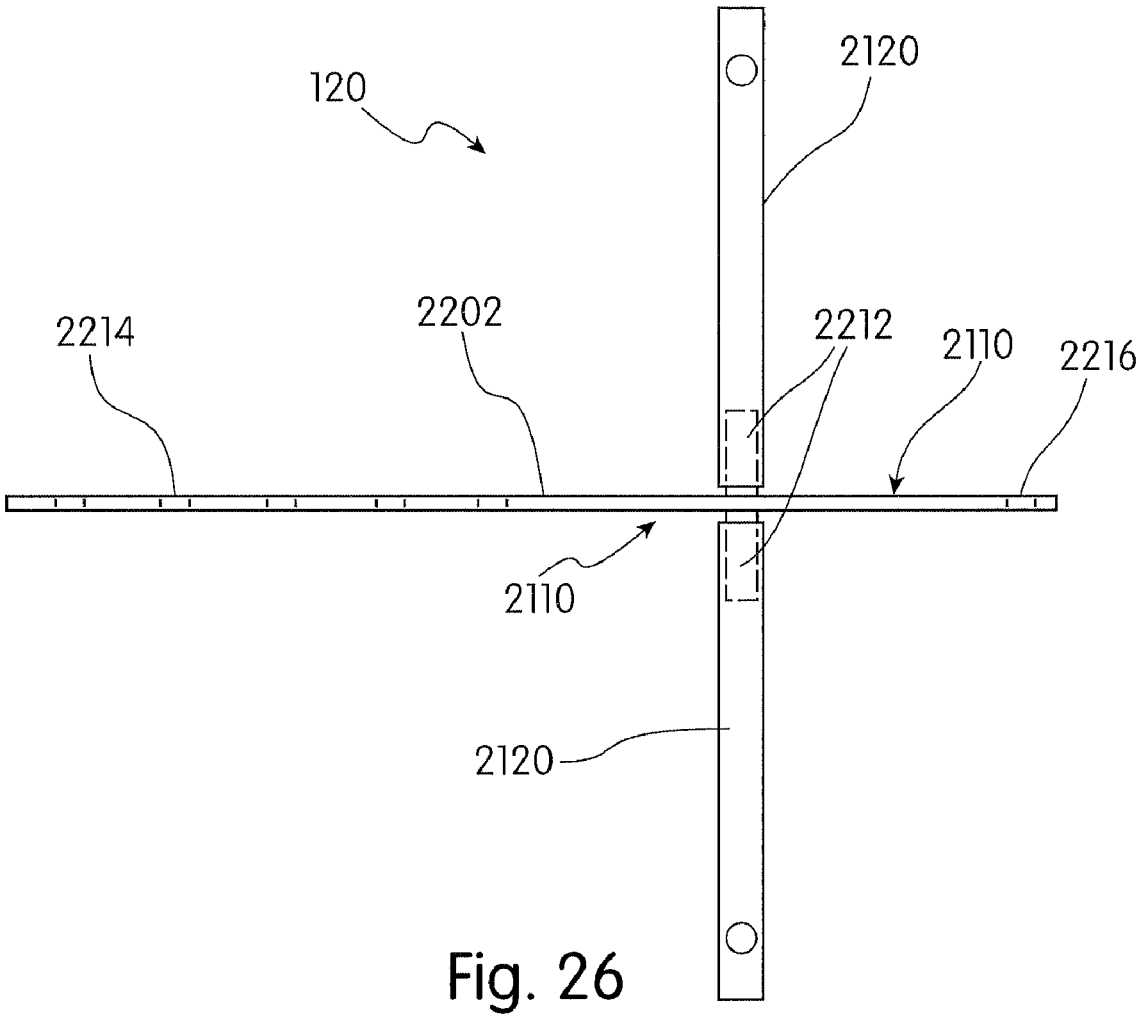
FIG. 26 is a top view of the array frame of FIG. 22 with extended cross-bars attached to each side of the array frame.

FIG. 26 is a top view of an array frame 120 with side arms 2120 attached to the side bars 2212 of center frame 2110 of the array frame 120. Also shown are the positions of the rear positioned holes 2214 and the front hole 2216 along the elongated bar 2202 of the center frame 2110.

Figure 27:
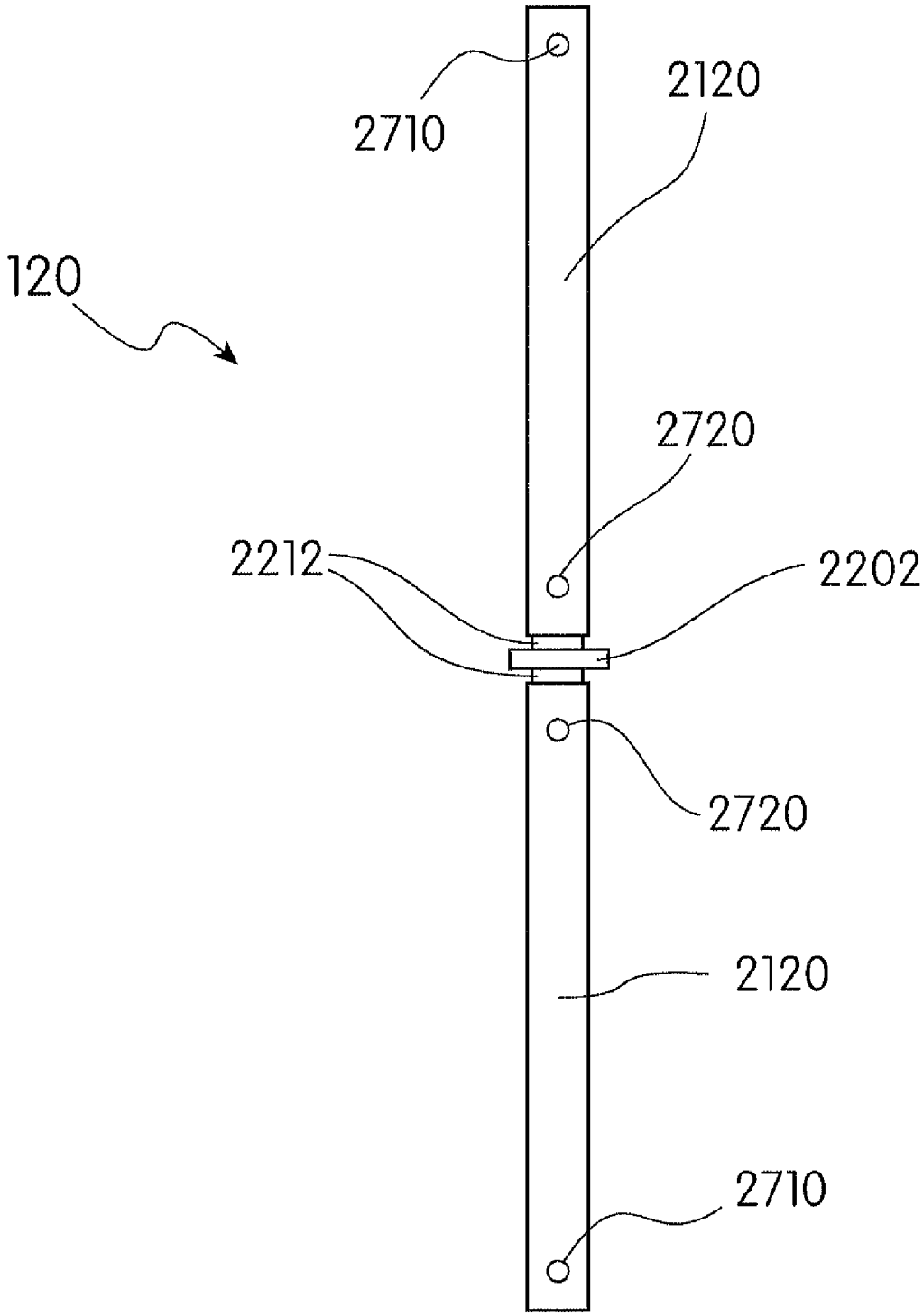
FIG. 27 is a front view of the array frame of FIG. 26.

FIG. 27 is a front view of the array frame 120 of FIG. 26. In this view, the holes 2720 in the side arms 2120 that align with the holes 2210 (FIG. 25) in the side bars 2212 extending from the elongated bar 2202 of the center frame 2110. Also illustrated in FIG. 27 are holes 2710 positioned near the free end of the side arms 2120. As further explained below, the side arms 2120 include a channel for receiving the pivotal member 920 of a rigging frame 110. The holes 2710 at the end of the side arms 2120 align with the opening 1020 (FIG. 12) at the free end of the pivotal member 920 for securing the array frame 120 to the rigging frame 110.

Figure 28:
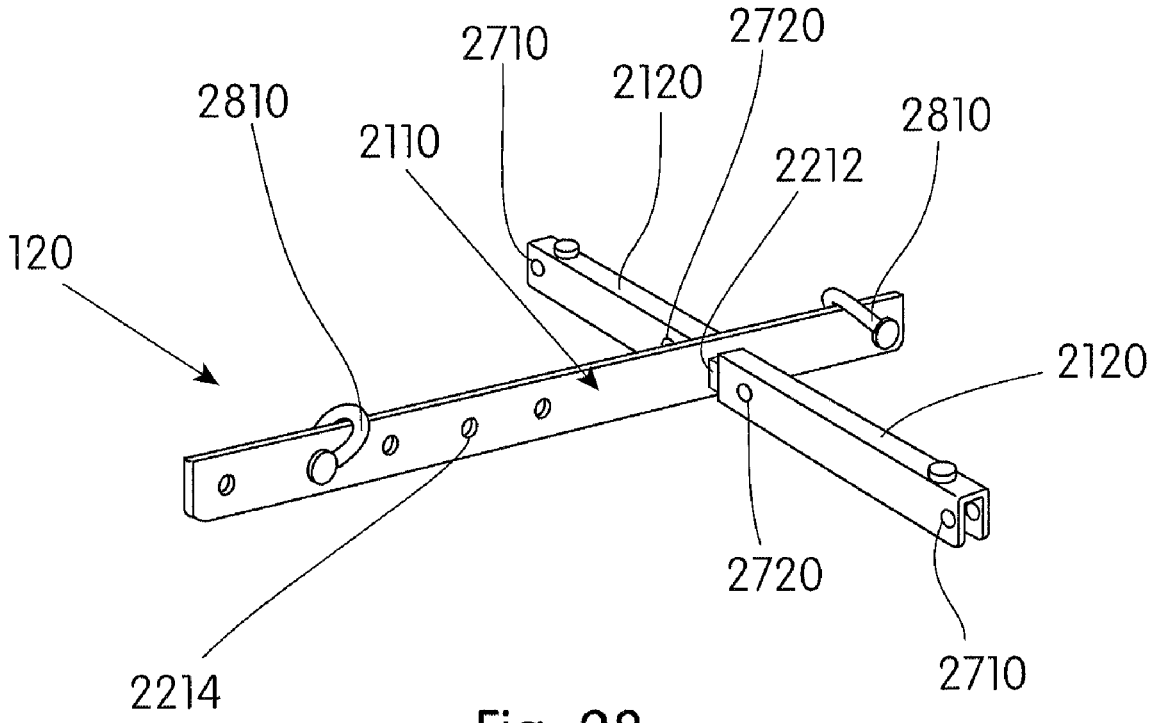
FIG. 28 is a perspective side view of the array frame of FIG. 26.

FIG. 28 is a perspective side view of the array frame 120 of FIG. 26. FIG. 28 illustrates that the side arms 2120 may be U-shaped or channel shaped members, similar to the rigging bars 910 of the rigging frame 110. The channel or U-shaped portion may extend along the entire length of the side arms 2120, or may just be provided at each end of the side arms 2120. At one end of the side arm 2120, the channel in the side arm 2120 is able to receive a side bar 2212 of the center frame 2110. At the other end of the side arm 2120, the channel is able to receive a pivotal member 920 of a rigging frame 110. Both ends of each side arm 2120 include aligning holes positioned on each side wall of the side arm 2120 defining the receiving end channel of the side arm 2120. Opposing holes 2720 at the end of each side arm 2120 nearest the center frame 2110 align with a hole 2210 in the side bars 2212 of the center frame 2110 for receiving a releasing pin 2820, as illustrated in FIG. 28.

Figure 29:
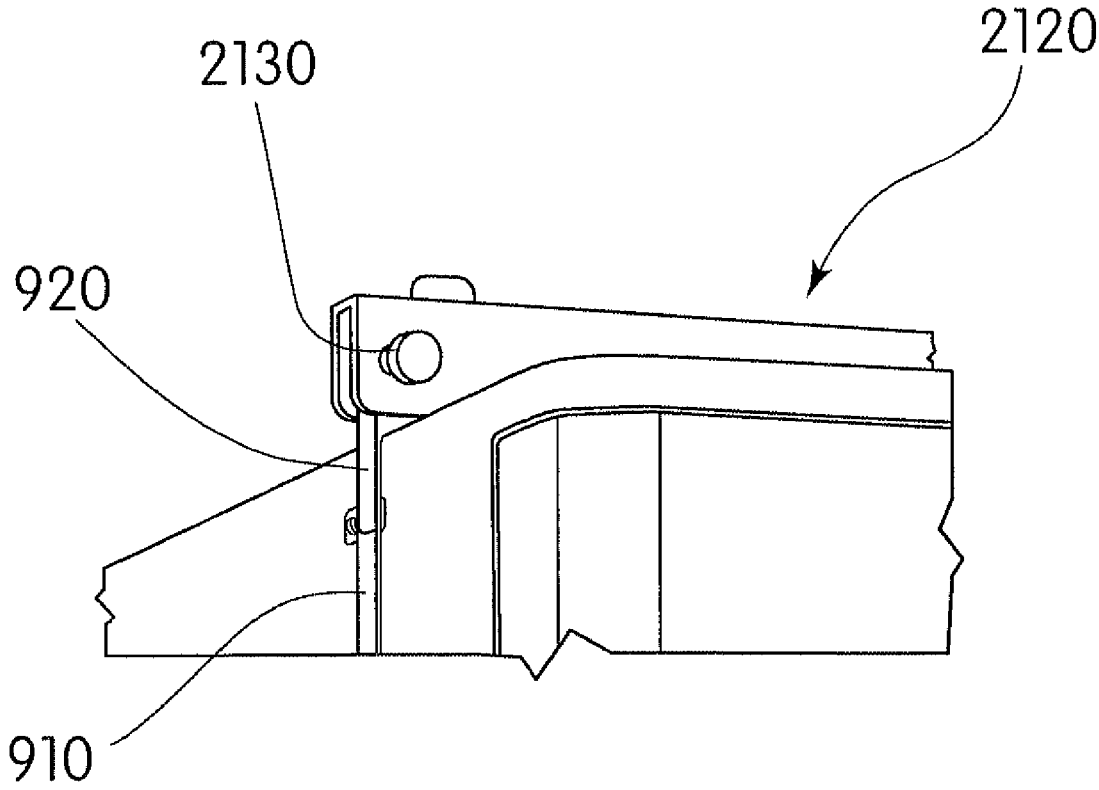
FIG. 29 is a side perspective sectional view of a portion of a loudspeaker illustrating one example of how the array frame may attach to a rigging frame.

FIG. 29 is a side perspective sectional view illustrating one example of how an array frame 120 may attach to a rigging frame 110. As shown in FIG. 29, the holes 2710 (See FIG. 27) on the free end of the side arms 2120 are designed to align with the holes 1020 at the end of the pivotal member 920 secured to a rigging bar 910. Once the holes 1020 in the pivotal member 920 and the holes 2710 in the free end of the side arm 2120 are aligned, a release pin 2130 can be inserted through the holes to mechanically secure the rigging frame 110 of the loudspeaker array to the array frame 120.

While various embodiments of the invention have been described, it will be apparent to those of ordinary skill in the art that other embodiments and implementations are possible within the scope of this invention. For example, the pivotal member 920 of the rigging bar 910 is not required to pivot between a stored position and a locking position. The pivotal member 920 may take the form of an engaging member that extends beyond one end of the rigging bar 910. The engaging member may be permanently positioned to extend beyond the end of the rigging bar 910, may be retractable, removable, or permanently or temporarily secured to the rigging bar 910 in any manner that allows the engaging member to extend outward beyond the end of the rigging bar 910 for receipt by the opposing end of second rigging bar 910. Once the engaging member is received by the second rigging bar 910 it may be secured to the second rigging bar 910 in the same manner as the pivotal member 920. For the purposes of this application, an engaging member may include, but not be limited to, a pivotal member 920. Accordingly, the invention is not to be restricted except in light of the attached claims and their equivalents.

What is claimed is:

1. A suspension system for suspending a loudspeaker, the suspension system comprising:

a first rigging bar having a first end and second end;

an engaging member having a secured end and a free end, where the secured end of the engaging member is pivotally affixed to the first end of the first rigging bar such that the free end of the engaging member is configured to rotate between a stored position in the first rigging bar, and an extended position such that the free end of the engaging member extends, at least partially, beyond the first end of the first rigging bar; and a frame engageable with the free end of the engaging member.

2. The system of claim 1 where the first rigging bar is channel shaped at its first end.

3. The system of claim 2 where the secured end of the engaging member is secured within the channel shaped first end of the first rigging bar.

4. The system of claim 3 where the secured end of the engaging member is pivotally secured within the channel shaped first end of the first rigging bar.

5. The system of claim 1 where the frame comprises an opening at a first end for receiving the free end of the engaging member, and the engaging member has a hole at its free end for aligning with a first hole in the frame.

6. The system of claim 5 where the first rigging bar is configured for mounting on a first side of a loudspeaker.

7. The system of claim 1 where the frame is configured for securing to and suspending a loudspeaker.

8. The system of claim 1 where the frame is configured for securing to and providing support for a standing loudspeaker.

9. A loudspeaker system comprising:

a loudspeaker;

a first rigging bar mounted to the loudspeaker, the first rigging bar having a first end and a second end; and a first engaging member having a secured end and a free end, the secured end being pivotally affixed to the first end of the first rigging bar such that the free end of the first engaging member is configured to rotate between a stored position in the first rigging bar and an extended position such that the free end of the first engaging member extends, at least partially, beyond the first end of the first rigging bar.

10. The loudspeaker system of claim 9 where the first rigging bar is channel shaped at its first end.

11. The loudspeaker system of claim 10 where the secured end of the first engaging member is pivotally secured within the channel shaped first end of the first rigging bar.

12. The loudspeaker system of claim 9 further comprising a frame that is engageable with the free end of the first engaging member.

13. The loudspeaker system of claim 9 where the loudspeaker has a first recessed channel for receiving the first rigging bar.

14. The loudspeaker system of claim 9 where the first rigging bar includes a gripping section for allowing a user to grip and carry the loudspeaker.

15. The loudspeaker system of claim 9 where the frame is secured to a section of the loudspeaker for suspending the loudspeaker.

16. A rigging frame for use in a suspension system for suspending a loudspeaker, the rigging frame comprising:

a first rigging bar having a first end and a second end, the first rigging bar being engageable with a loudspeaker; and a first engaging member having a secured end and a free end, where the secured end is pivotally affixed to the first end of the first rigging bar such that the free end of the first engaging member is configured to rotate between a stored position in the first rigging bar, and an extended position such that the free end of the first engaging member extends, at least partially, beyond the first end of the first rigging bar.

17. The rigging frame of claim 16 where the first rigging bar is channel shaped at its first end.

18. The rigging frame of claim 17 where the secured end of the first engaging member is pivotally secured within the channel shaped first end of the first rigging bar.

19. The rigging frame of claim 16 where the first rigging bar has a generally straight central portion and two opposing angular portions extending from the central portion.

20. The rigging frame of claim 16 where the second end of the first rigging bar includes a channel for engagement with an engaging member of a second rigging bar.

* * * * *

UNITED STATES PATENT AND TRADEMARK OFFICE

CERTIFICATE OF CORRECTION

PATENT NO. : 7,997,552 B2
APPLICATION NO. : 12/402348
DATED : August 16, 2011
INVENTOR(S) : Engebretson et al.

It is certified that error appears in the above-identified patent and that said Letters Patent is hereby corrected as shown below:

At column 4, line 27, "speaker array 100..." should be changed to --speaker array 10 (in FIG. 4)...--

At column 5, line 29, "...rigging frame of FIG. 9..." should be changed to --...rigging frame 110 of FIG. 9...--

At column 6, line 40, "...rigging frame 110..." should be changed to --rigging frame 110 (FIG. 9)...--

At column 6, line 62, "...holes 1010 (FIG. 12)..." should be changed to --...holes 1010 (FIG. 10)...--

At column 6, line 63, "...opening 1020 (FIG. 11)..." should be changed to --...opening 1020 (FIG. 12)...--

At column 7, line 36, "...loudspeaker,..." should be changed to --...loudspeaker 1410,...--

At column 7, line 44, "...opening 1020 of..." should be changed to --...opening 1020 (FIG. 10) of...--

At column 8, line 25, "...loudspeaker 1930" should be changed to --...loudspeaker 1910--

At column 8, line 26, "...loudspeakers in the" should be changed to --...loudspeakers 1920 in the--

At column 8, line 27, "loudspeaker array,..." should be changed to --loudspeaker array 1900,...--

At column 8, line 28, "...loudspeaker,..." should be changed to --...loudspeaker 2100,...--

At column 8, line 30, "1900." should be changed to --1900 in FIG. 19.--

At column 8, line 35, "...side aims 2120..." should be changed to --...side arms 2120...--

At column 8, line 39, "rigging frame 110..." should be changed to --rigging frame 110 (FIG. 9)...--

Signed and Sealed this
Twenty-fourth Day of January, 2012

David J. Kappos
*Director of the United States Patent and Trademark Office*

At column 8, line 53, "...side thins 2120..." should be changed to --...side arms 2120...--

At column 9, line 25, "920 of..." should be changed to --920 (FIG. 10) of...--

At column 9, line 39, "...holes positioned" should be changed to --...holes 2710 positioned--

At column 9, line 44, "...pin 2820,..." should be changed to --...pin (not shown),...--

At column 9, line 46, "...array frame 120..." should be changed to --...array frame 120 (FIG. 8)...--

At column 9, line 47, "frame 110..." should be changed to --frame 110 (FIG. 9)...--

At column 9, line 49, "...holes 1020 at..." should be changed to --...holes 1020 (FIG. 10) at...--